United States Patent [19]

Geldzahler et al.

[11] 4,016,051

[45] Apr. 5, 1977

[54] ADDITIVES FOR BRIGHT PLATING NICKEL, COBALT AND NICKEL-COBALT ALLOYS

[75] Inventors: Charles Geldzahler; Satwant S. Sodhi, both of Chicago, Ill.

[73] Assignee: Starlite Chemicals, Inc., Chicago, Ill.

[22] Filed: May 2, 1975

[21] Appl. No.: 574,031

[52] U.S. Cl. ..... 204/43 T; 204/48; 204/49; 204/DIG. 2

[51] Int. Cl.[2] ..... C25D 3/12; C25D 3/56

[58] Field of Search ..... 204/4.9, DIG. 2, 43 T, 204/48

[56] References Cited

UNITED STATES PATENTS

| | | | |
|---|---|---|---|
| 2,712,522 | 7/1955 | Kardos et al. | 204/49 |
| 3,133,006 | 5/1964 | Ostrow et al. | 204/49 |
| 3,506,548 | 4/1970 | Duchene | 204/49 |

FOREIGN PATENTS OR APPLICATIONS

| | | |
|---|---|---|
| 1,023,201 | 3/1966 | United Kingdom |

*Primary Examiner*—F. C. Edmundson

*Attorney, Agent, or Firm*—Allegretti, Newitt, Witcoff & McAndrews

[57] ABSTRACT

An acidic aqueous solution for use in bright nickel, cobalt, or nickel-cobalt alloy electroplating which includes nickel, cobalt, or nickel-cobalt ions respectively, and at least 0.005 but not exceeding 0.3 grams per liter of the solution consisting of diethylaminopropyne sulfate. The invention also relates to a process for producing bright nickel, cobalt or nickel-cobalt alloy deposits which comprises electrodepositing nickel, cobalt or nickel-cobalt alloy from an aqueous acidic solution containing at least one salt of nickel, cobalt or nickel-cobalt and containing as an addition agent from about 0.005 to about 0.3 grams per liter of the solution consisting of diethylaminopropyne sulfate. In the process, the solution may be heated above 60° C so as to increase the efficiency of the process.

5 Claims, No Drawings

ADDITIVES FOR BRIGHT PLATING NICKEL, COBALT AND NICKEL-COBALT ALLOYS

BACKGROUND OF THE INVENTION

This invention relates to the electrodeposition of bright ductile fine-grained nickel, cobalt or nickel-cobalt alloy from aqueous acidic nickel, cobalt and nickel-cobalt plating electrolytes. More particularly, this invention relates to the use in these electrolytes of certain acid derivatives of aminoacetylenic compounds.

The use of aminoacetylenic compounds was proposed in Kardos et. al., U.S. Pat. No. 2,712,522. But the use of such compounds has been limited because of the tendency of these compounds of yield rather brittle deposits of nickel. The hydrochloric acid derivatives of aminoactylenic compounds have been used as shown in Law U.S. Pat. No. 3,546,081 and Great Britain Pat. No. 1,143,257. These latter compounds are volatile and are driven from the electrolyte by the elevated temperatures used in bright nickel, cobalt and nickel-cobalt alloy electrodeposition. It is desirable to use higher temperatures for the bath in order to increase the efficiencies of the bath and to provide for a greater electrodeposition coating in a shorter period of time.

An object of the present invention is to provide an improved acidic aqueous solution for use in bright nickel, and nickel-cobalt alloy electroplating.

Another object of the present invention is to provide an improved process for producing bright nickel, cobalt or nickel-cobalt alloy deposits which includes heating the bath to temperatures above 60° C so as to increase the efficiency thereof, the bath including as an addition agent from about 0.005 to about 0.3 grams per liter of the solution consisting of, diethylaminopropyne sulfate. Other objects and advantages of the present invention will become more apparent hereinafter.

DETAILED DESCRIPTION OF THE PRESENT INVENTION

We have unexpectedly found that the problems derived from utilization of hydrochloric acid derivatives of aminoacetylenic compounds can be obviated by use of sulfuric acid and sulfamic acid derivatives of the aminoacetylenic compounds. The sulfuric acid and sulfamic acid derivatives of the aminoacetylenic compounds have been found to be very stable in the electroplating solutions even at temperatures close to the boiling point. It is possible to crystallize the sulfuric acid and sulfamic acid derivatives from aqueous solutions by evaporation at atmospheric pressure of the water, whereas, when the hydrochloric acid derivatives of these aminoacetylenic compounds were subjected to the same treatment, the hydrochloric acid was driven from the compounds and the aminoacetylenic compound decomposed.

The sulfuric acid and sulfamic acid derivatives of the aminoacetylenic compounds, and in particular, the sulfuric acid and sulfamic acid derivatives of diethylaminopropyne and dimethylaminopropyne are used in a concentration of 0.005 – 0.3 grams per liter in conjunction with sulfo-oxygen compounds to give brightness and leveling to the electrodeposits of nickel, cobalt and nickel-cobalt alloys. These sulfo-oxygen compounds may be any of those listed in Table I. These compounds may be used alone or in combination.

TABLE I (A) Unsaturated aliphatic sulfonic acids, and alkali metal, ammonium, magnesium and nickel salts thereof:
Sodium vinyl sulfonate, $H_2C{=}CHSO_3Na$
Sodium allyl sulfonate, $H_2C{=}CHCH_2SO_3Na$ (B) Mononuclear aromatic sulfonic acids, and alkalik metal, ammonium, magnesium and nickel salts thereof:
Benzene monosulfonic acid, $C_6H_5SO_3H$
Sodium Benzene monosulfonate, $C_6H_5SO_3Na$
Nickel Benzene monosulfonate, $(C_6H_5SO_3)_2H_3Ni$
Sodium para-toluene monosulfonate, $CH_3C_6H_3SO_3Na$
Para-chlorobenzene sulfonic acid, $ClC_6H_4SC_3H$
Sodium para-chlorobenzene sulfonate, $ClC_6H_4SO_3Na$
Sodium para-bromobenzene sulfonate, $ClC_6H_4SO_3Na$
1,2 dichlorobenzene sulfonic acid, $Cl_2C_6H_3SO_3H$
1,2 or 2.5 dichlorobenzene sulfonate sodium salt, $Cl_2C_6H_3SO_3Na$
Sodium phenylethylene sulfonate, $C_6H_5CH{=}CHSO_3Na$
Meta benzene disulfonic acid, $C_6H_4(SO_3H)_2$
Sodium meta-benzene disulfonate, $C_6H_4(SO_3Na)_2$
Nickel meta-benzene disulfonate, $C_6H_4(SO_3)_2Ni$
Ortho-sulfobenzoic acid nomoammonium salt, $HOCOC_6H_4SO_3NH_4$
1-amino-2,5-benzene disulfonic acid, $H_2NC_6H_3(SO_3H)_2$
Ortho-aminobenzene sulfonic acid, $H_2NC_6H_4SO_3H$ (C) Mononuclear aromatic sulfinic acids, and alkali metal, ammonium, magnesium and nickel salts thereof:
Sodium benzene sulfinate, $C_6H_5SO_2Na$
Sodium para-toluene sulfinate, $CH_3C_6H_4SO_2Na$ (D) Mononuclear aromatic sulfonamides and imides:
Benzene sulfonamide, $C_6H_5SO_2NH_2$
Para-toluene sulfonamide, $CH_3C_6H_4SO_2NH_2$
Ortho-benzoic sulfimide, $C_6H_4CONHSO_2$ (saccharin)
Benzyl sulfonamide, $C_6H_2SO_2NH_2$
Benzene sulfhydroxamic acid, $C_6H_5SO_2NHOH$
N, N dimethyl para-toluene sulfonamide, $CH_3C_6H_4SO_2N(CH_3)_2$
N, N dicarboxyethyl benzene sulfonamide, $C_6H_5SO_2N(C_2H_4COOH)_2$ (E) Binuclear aromatic sulfonic acids and alkali metal, ammonium, magnesium and nickel salts thereof:
2-naphthalene monosulfonic acid, $C_{10}H_7SO_3H$
1, 5 or 2, 7-naphthalene disulfonic acid, $C_{10}H_6(SO_3H)_2$
1,5 or 2, 7-naphthalene disulfonic acid nickel salt, $C_{10}H_6(SO_3)Ni$
Naphthalene trisulfonic acid, $C_{10}H_5(SO_3H)_3$
Naphthalene trisulfonic acid trisodium salt, $C_{10}H_3(SO_3Na)_3$
Diphenyl pp8disulfonic acid, $HSO_3C_6H_4 - C_6H_4SO_3H$
2-naphthol-3,6-disulfonic acid, $HOC_{10}H_5(SO_3H)_2$
2-naphthol-3,6-disulfonic acid sodium salt, $HOC_{10}H_5(SO_3Na)_2$
1-naphthylamine 3,6,8, trisulfonic acid, $H_2N \cdot C_{10}H_4(SO_3H)_3$ (F) Heterocyclic sulfonic acids and alkali metal, ammonium, magnesium and nickel salts thereof:
Thiophene sulfonic acid, $C_4H_3SO_3H$
Sodium thiophene sulfonate, $C_4H_3SO_3Na$
2-(4-pyridyl) ethyl sulfonic acid, $C_5H_4N \cdot CH_2CH_2SO_3H$ The sulfuric acid derivative of diethylaminopropyne is prepared by treating the amine with dilute sulfuric acid at temperatures not exceeding 15° C. Preferably, the amine is retained in a glass or glass-lined steel vessel disposed within a cooling tank and the diluted sulfuric acid (12 normal solution) is introduced into the amine with vigorous agitation until a pH is obtained in the range 4.2 – 4.5.

The sulfamic acid derivative is prepared at room temperature utilizing a 12 normal solution of sulfamic acid which is allowed to drip into the amine in a glass or glass-lined steel vessel disposed within a cooling tank to retain room temperature within the vessel, with the solution being vigorously agitated until a pH in the range of 4.2 – 4.5 is obtained.

The examples of plating solutions as provided in Table II below, were plated in 2.67 ml Hull Cells using a current of two ampheres, with air agitation, for ten

(10) minutes. The cathodes were polished brass panels which were cleaned in accordance with the best plating practices.

TABLE II

| Example: | Grams per Liter | | | | | | | | | | | |
|---|---|---|---|---|---|---|---|---|---|---|---|---|
| | 1 | 2 | 3 | 4 | 5 | 6 | 7 | 8 | 9 | 10 | 11 | 12 |
| Nickel sulfate, $NiSO_4 \cdot H_2O$ | 300 | 75 | 300 | 300 | 300 | 300 | | | | | 250 | 250 |
| Cobalt sulfate, $CoSO_4H_2O$ | | | | | | | 300 | 300 | 300 | 300 | 50 | 50 |
| Nickel chloride | 60 | 200 | 60 | 60 | 60 | 60 | | | | | 60 | 60 |
| Cobalt chloride | | | | | | | 30 | 30 | 30 | 30 | | |
| Boric acid | 45 | 45 | 45 | 45 | 45 | 45 | 45 | 45 | 45 | 45 | 45 | 45 |
| Saccharin,sodium salt | 2 | 3 | 2 | 2 | 2 | | 2 | 2 | 2 | 2 | 2 | 2 |
| 1,3,6 Naphthalene trisulfonic acid | | | | | | 4 | | | | | | |
| Sodium paratoluene sulfinite | 0.02 | 0.03 | 0.02 | 0.02 | 0.02 | 0.02 | 0.02 | 0.02 | 0.02 | 0.02 | 0.02 | 0.02 |
| Sodium allyl sulfonate | 2 | 2 | 2 | 2 | 2 | 2 | 2 | 2 | 2 | 2 | 2 | 2 |
| Dimethylaminopropyne sulfate | 0.15 | 0.15 | | | | 0.15 | 0.15 | | | | 0.15 | |
| Diethylaminopropyne sulfate | | | 0.15 | | | | | 0.15 | | | | 0.15 |
| Dimethylaminopropyne sulfamate | | | | 0.15 | | | | | 0.15 | | | |
| Diethylaminopropyne sulfamate | | | | | 0.15 | | | | | 0.15 | | |
| Temperature, ° C | 65 | 65 | 65 | 65 | 65 | 65 | 65 | 65 | 65 | 65 | 65 | 65 |
| pH | 4 | 4 | 4 | 4 | 4 | 4 | 4 | 4 | 4 | 4 | 4 | 4 |

In Examples 1–6, pure electrolytic nickel anodes were used. In Examples 7–10, pure electrolytic cobalt anodes were used. In Examples 11 and 12, nickel-cobalt alloy consisting of about seventy percent (70%) nickel and thirty percent (30%) cobalt was used for the anode. All the test panels shown bright ductile deposits over the current density range of 2–125 amperes per square foot. The deposits obtained from the electrodeposition of Examples 11 and 12 ranged in cobalt content of approximately thirty percent (30%).

The brightening effect of the sulfuric acid and the sulfamic acid derivatives of the aminoacetylenic compounds used in conjunction with the sulfo-oxygen compounds of Table I were not restricted to sulfate-chloride-boric acid electrolytes of nickel, cobalt and nickel-cobalt, but appeared also in the all-sulfate, sulfate-boric acid, sulfate-chloride, sulfate-fluoborate-boric acid, fluobrate-chloride boric acid, sulfamate-boric acid, sulfamate-boride boric acid, sulfamate-boric acid and sulfamate chloride boric acid electrolytes of nickel, cobalt and nickel-cobalt.

Comparative test utilizing the same baths and conditions except for the substitution of hydrochloric acid derivatives for the sulfuric acid derivatives demonstrate the advantages of the present invention. A bath as set forth in Example 1, Table II, was used, except that the temperature was 56° C, two amperes current and twenty minutes time, the sample plates with dimethylaminopropyne sulfate and dimethylaminopropyne hydrochloride were comparable in visual appearance. At the same conditions, except with temperature increased to 75° C, 90° C and boiling, the sample plates from the sulfuric acid derivative bath showed no change. Each sample had a desirable high quality luster and the efficiency of the bath increased with elevated temperature. The samples from the hydrochloric acid derivative bath showed declining quality of 75°, 90° C and boiling because of the breakdown of the dimethylaminopropyne hydrochloride. Tests have shown that the hydrochloric acid derivative starts to break down above 60° C and produce inferior results as compared to the present invention.

By utilization of the present invention, the bath is made more efficient at higher temperatures so as to provide a greater thickness of deposit in a lesser time. In contrast to hydrochloric acid derivatives, the sulfuric acid and sulfamic acid derivatives of the present invention will not loose luster in temperatures in excess of 60° C and will not be decomposed.

What is claimed is:

1. A process for producing bright nickel, cobalt or nickel-cobalt alloy deposits which comprises, electrodepositing nickel, cobalt or nickel-cobalt from an acidic aqueous plating solution of at least one salt of nickel, cobalt or nickel-cobalt and containing from about 0.005 to about 0.3 grams per liter of diethylaminopropyne sulfate, which is made by the method comprising the steps of adding diluted sulfuric acid slowly to the amine while vigorously agitating the solution, maintaining the solution at a temperature not exceeding 15° C, and terminating the addition of the diluted sulfuric acid when a pH in the range of 4.2 to 4.5 is obtained and including heating the plating solution above 60° C so as to increase the efficiency of the process.

2. An acidic aqueous solution as in claim 1 wherein there is 0.15 grams per liter of said addition agent in the solution.

3. An acidic aqueous solution for use in bright nickel, cobalt or nickel-cobalt alloy electroplating which contains (a) from 0.2 to 20 grams per liter of a sulfoxygen compound selected from the group consisting of mononuclear aromatic sulfonic acids, binuclear aromatic sulfonic acids, and heterocyclic sulfonic acids, and alkali metal, ammonium, magnesium, nickel and cobalt salts of said acids; (b) at least one nickel and/or cobalt salt selected from the group consisting of nickel and/or cobalt sulfates, nickel and/or cobalt chloride, nickel and/or cobalt formate, nickel and/or cobalt fluoborate and nickel and/or cobalt sulfamate; (c) boric acid; and (d) 0.005 to 0.3 grams per liter of an addition agent consisting of diethylaminopropyne sulfate which is made by the method comprising the steps of adding diluted sulfuric acid slowly to the amine while vigorously agitating the solution maintaining the solution at a temperature not exceeding 15° C, and terminating the addition of the diluted sulfuric acid when a pH in the range of 4.2 to 4.5 is obtained.

4. A solution as in claim 3, wherein the sulfo-oxygen compound 1:3:6 napthalene trisulfonic acid.

5. A solution as in claim 3, wherein the sulfo-oxygen compound is saccharin.

* * * * *